US006042443A

United States Patent [19]

Carella et al.

[11] Patent Number: 6,042,443

[45] **Date of Patent: *Mar. 28, 2000**

[54] FIELD EMITTER FLAT DISPLAY CONTAINING A GETTER AND PROCESS FOR OBTAINING IT

[75] Inventors: Sergio Carella, Varese; Claudio Boffito, Milan, both of Italy

[73] Assignee: Saes Getters S.P.A., Milan, Italy

[ * ] Notice: This patent is subject to a terminal disclaimer.

[21] Appl. No.: 09/321,509

[22] Filed: May 27, 1999

Related U.S. Application Data

[63] Continuation of application No. 08/631,915, Apr. 15, 1996, Pat. No. 5,934,964.

[30] Foreign Application Priority Data

Feb. 28, 1994 [IT] Italy ..... MI94A0359

[51] Int. Cl.[7] ..... H01J 9/385

[52] U.S. Cl. ..... 445/24; 445/41

[58] Field of Search ..... 445/24, 41, 55

[56] References Cited

U.S. PATENT DOCUMENTS 3,620,645 11/1971 Della Porta ..... 445/55

*Primary Examiner*—Kenneth J. Ramsey
*Attorney, Agent, or Firm*—Hickman Stephens Coleman & Hughes, LLP

[57] ABSTRACT

A process for producing a field emitter flat display includes providing a supported porous layer of a non-evaporable getter material by depositing the non-evaporable getter material on a substrate followed by sintering the deposited material. The substrate having the porous layer of non-evaporable getter material thereon is then housed in an inner space defined by opposing plates. The inner space is then evacuated and hermetically sealed. The non-evaporable getter material is preferably deposited by preparing a suspension of non-evaporable getter material particles in a suspending medium, coating a surface of a substrate with the suspension by, e.g., spraying, and sintering the coating.

20 Claims, 5 Drawing Sheets

FIELD EMITTER FLAT DISPLAY CONTAINING A GETTER AND PROCESS FOR OBTAINING IT

This application is a continuation of U.S. patent application Ser. No. 08/631,915, filed Apr. 15, 1996, now U.S. Pat. No. 5,934,964, which claims priority from U.S. patent application Ser. No. 08/396,133, filed Feb. 28, 1995, which in turn claims priority from Italian Patent Application No. MI94 A 000359, filed Feb. 28, 1994. All of the aforementioned applications are incorporated herein by reference.

BACKGROUND OF THE INVENTION

The present invention relates to flat displays and methods for their construction. More particularly, the present invention relates to a field emitter flat display having an inner vacuum space. The displays of this kind are often referred to as FEDs (Field Emitter Displays) and belong to the wider family of Flat Panel Displays (FPDs).

In detail, a FED contains a plurality of pointed microcathodes (microtips), which emit electrons, and a plurality of grid electrodes, placed at a very short distance from the cathodes, so as to generate a very high electric field. Between the cathodes and the phosphors is a vacuum space, which may be in certain cases some tens to some hundreds of micrometers ($\mu$m) thick. The cathode may also be a diamond emitter. The vacuum in the vacuum space is usually kept under $10^{-5}$ millibar (mbar).

Sometimes the points of the microcathodes, the grid electrodes and the phosphors are aligned on a single flat surface, as described by Henry F. Gray, "Information Display" (3/93, page 11).

The patent document EP-A-0443865 describes a process for preparing a FED wherein a non-conducting substrate, for instance quartz, which supports the microcathodes and possibly the grid electrodes, in addition to possible auxiliary acceleration-anodes, is coated, in a part thereof free from cathodes and other electrodes, with a thin layer of an evaporable getter alloy based on barium, for instance $BaAl_4$.

The thus obtained FEDs, however, present some disadvantages; in fact, getters of this kind require, to be operative, an activating heat-treatment (>800° C.) which may be usually carried out by means of radio frequencies, emitted by induction coils outside the FED. In cases where an evaporable getter material is employed, the heat-treatment should deposit a film of metal (for instance barium, one of the most commonly used evaporable getters) on well-defined and localized zones of the inner surface of the FED.

As barium is a good electrical conductor, its deposits, especially in a very small space as in the FEDs, may cause short circuits or electric breakdowns of the insulating surfaces; furthermore, such treatment may cause localized thermal shocks so as to seriously endanger the mechanical resistance of the FEDs.

Generally, the very small available space hinders the insertion of a getter having enough gas sorption capacity.

Some workers, in the past, have proposed to add to the displays an appendix or "tail" C, as shown in FIG. 1, intended to house a getter G without interfering with the thickness of the vacuum space between microtips MT and screen SCH. Such a technique, however, excessively increases the thickness, and therefore the volume, of the displays.

More recently, the application EP-A-572170 suggests to substitute the evaporable getter with other particular kinds of getter, for instance zirconium, which belong to the family of the non-evaporable getters (NEG), preferably present in large amount, such as, for example, microcathodes (microtips).

However, this suggestion is not free from negative consequences: the electronic emission of the sharp point of the microtips, if exposed to oxygenated gases, may be changed because of the production of zirconium oxide.

Another disadvantage is due to the difficulties which arise when the microtips are created, usually through a chemical etching of preformed layers. This technique leaves foreign materials within the microtips, which therefore lose most of their gettering capacity.

SUMMARY OF THE INVENTION

It is therefore an object of the present invention to provide a FED, which overcomes at least one of the above mentioned inconveniences of the prior art.

Further objects of the present invention are the elimination of the deposits of getter material or other material on undesired zones inside the FEDs, and the integration of a getter into the very limited space of the FEDs, so as to simultaneously make its manufacture easier.

Other objects will become clear from the following description.

In a preferred embodiment, the present invention includes a field emitter flat display, having an inner vacuum space wherein there are housed:

a) a layer of excitable phosphors and a plurality of microcathodes, which emit electrons driven by a high electric field; and b) a plurality of electric feedthroughs and a vacuum stabilizer, wherein said vacuum stabilizer is essentially formed of a porous supported layer of a non-evaporable getter material, between about 20 and 180 (preferably 20–150) $\mu$m thick, which layer is housed in a zone essentially free from microcathodes, phosphors and feedthroughs.

DESCRIPTION OF THE PREFERRED EMBODIMENT

In the field of the FEDs there was not, until now, any defined solution of the problems relating to the choice of the getter material and to the method for the manufacture of these FEDs; more precisely, the special features of the FEDs asked pressing and delicate questions about the size, the quality and the easiness of the manufacture, with regard to the production and the conservation of the vacuum necessary for its working.

The displays according to the invention are a successful choice which answers to the above mentioned questions in an extremely satisfying way.

Figure 1:
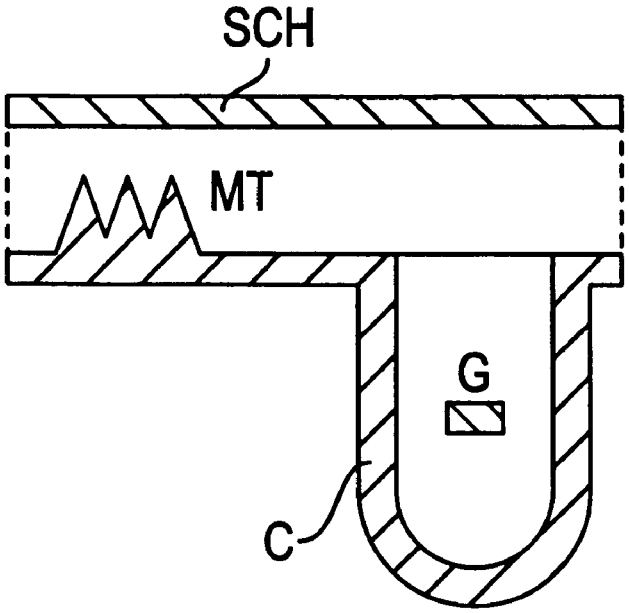
FIG. 1 (PRIOR ART)
FIG. 1 is a cross-sectional view of an FED according to the prior art.
Figure 2:
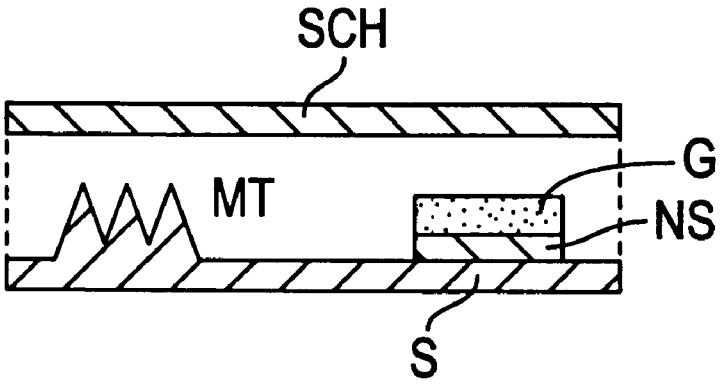
FIG. 2 is a simplified cross-sectional view of a FED according to the present invention.

The inner space of the FED according to the invention is preferably defined, as shown in FIG. 2, by two thin plates made of an insulating material, one essentially parallel to the other, hermetically sealed along the perimeter and separated by a high-vacuum space, having a thickness of some tens or hundreds to some thousands of $\mu$m. A first plate (SCH) supports the phosphors and the second plate (S) supports the microcathodes, for example made of molybdenum, and possibly also some grid electrodes, for example made of niobium, as well as one or more porous layers of a non-evaporable getter material Such layers are then placed between said two thin plates and thus these layers (or thin stripes) are an integral part of the display (FED).

The supported porous layers, present in the displays according to the invention, are based on getter materials having in certain cases a very low activation temperature (<500° C. and even <450° C.), which may be applied with different methods on thin metallic and non-metallic substrates, and which may advantageously have, after the application, a possibly long sintering treatment; said treatment strengthens said getter materials, thereby preventing them from losing some particles which are extremely harmful to the above mentioned purposes.

Getter materials particularly suitable to the object are sintered compositions essentially made of:

A) A component "A" selected from the group consisting of zirconium, titanium and/or thorium, their respective hydrides and their combinations; and:

B) A "B" component getter selected from the group consisting of:

i) Zr—Al alloys according to U.S. Pat. No. 3,203,901, and Zr—Ni and

Zr—Fe alloys according to U.S. Pat. Nos. 4,071,335 and 4,306,887;

ii) Zr—M1—M2 alloys, according to U.S. Pat. No. 4,269,624 (where M1 is V or Nb and where M2 is Fe or Ni) and the Zr—Ti—Fe alloys, according to U.S. Pat. No. 4,907,948;

iii) the alloys containing zirconium and vanadium and in particular the Zr—V—Fe alloys according to EP-A-93/830411;

iv) their combinations.

In a preferred embodiment, the above-described getter materials include the compositions sold commercially as St 121 and/or St 122, manufactured and commercialized by SAES Getters, S.p.A. (Milan, Italy), essentially consisting of the two following groups of components:

An "H" component comprising titanium hydride; and

A "K" component comprising getter alloys selected from the group consisting of:

a) Zr—Al alloys according to the aforesaid item B(i) as described above, and in particular alloys containing 84% by weight of zirconium (for St 121);

b) Zr—V or Zr—V—Fe alloys according to the aforesaid item B(iii) as described above (for St 122); and c) their combinations, turned out to be particularly advantageous for the purpose.

The displays according to the invention can be obtained with different methods. According to a preferred embodiment, the displays are obtained with a process wherein:

a) providing a porous layer by depositing a non-evaporable getter material on a substrate and by sintering the deposited material to form a support layer.

b) having the thus obtained support layer in an inner space together with other components of the display; and c) evacuating and hermetically sealing the inner space.

The depositing of the getter material on the substrate is preferably carried out by means of electrophoresis or by means of a manual or mechanical application, preferably sprays, of a suspension of the getter material particles in a suspending medium.

A mechanical application different from the spray coating may be, for example, the spreading of a suspension of getter material particles, carried out by one or more panels or by means of a spreading machine with a scraping blade.

With regard to the electrophoretic methods see the previous patents GB-B-2,157,486 and EP-B-0275844, granted to the assignee of the present invention.

The choice of suspending medium will depend on the method of getter material deposition. For example, if electrophoretic deposition is used a preferred suspending medium is water mixed with ketones, esters and/or alkanols as described in British Patent No. 2,157,486 and U.S. Pat. No. 5,242,559, both of which are incorporated herein by reference. A particularly preferred suspending medium is a mixture of water and alcohol, more preferably ethyl alcohol. The water:organic ratio is preferably between about 3:1 and about 1:3 and more preferably between about 1:1 and about 1:2.5. The mixture preferably further contains a binder comprising between about 5% and about 15% of the liquid volume, which binder is preferably an aqueous solution of aluminum hydroxide. Preferably the weight ratio of solids to liquids in the suspension is between about 3:1 and about 1:2; and more preferably between about 2:1 and about 1:1.

For spray coating, a preferred suspending medium is an alcohol/ester mixture. A preferred medium is described below in the Example and comprises a mixture of isobutyl alcohol and isobutyl acetate. Preferred alcohol:ester ratios are between about 5:1 and about 1:5. In addition, a binder, preferably nitrocellulose, and methylene chloride ($CH_2Cl_2$) can also be added. Preferably, the methylene chloride is added in an amount less than about one third of the total volume of the suspension. The nitrocellulose binder can be added to an amount up to between about 2% and about 3% of the combined weights of the alcohol, ester, methylene chloride and nitrocellulose.

In order to hermetically seal the inner space of the display a frit sealing under vacuum pumping is usually performed, preceded by a high degassing, under vacuum pumping, from the inner space and from the surrounding walls. The frit sealing and the degassing are carried out at high temperatures, which can be usefully exploited in order to perform the necessary thermal activation of the getter material (without activation a getter cannot perform its functions). These steps can be performed without resorting to any of the separate activations, for instance by means of induction coils, which were used in the past. It should be noted, by the way, that this is possible due to the properties of the above described getter materials, which have very low activating temperatures.

An even more preferred embodiment of the aforesaid process provides for preparing the porous support layer of non-evaporable getter material, comprising the following steps:

a) preparing a suspension of non-evaporable getter material particles in a suspending medium;

b) coating a substrate using the suspension and resorting to the spray coating technique; and c) sintering the coated substrate.

The aforesaid particles are preferably made of a mixture of:

An "H" component comprising titanium hydride particles, having an average size of between about 1 and 10 (preferably 3 to 5) μm and a surface area of 1 to 8.5 (preferably 7 to 8) $m^2/g$; and A "K" component comprising getter alloy particles, having an average size of between about 5 and 15 (preferably 8 to 10) μm and a surface area of between about 0.5 to 2.5 $m^2/g$;

wherein the getter alloy is chosen from the group consisting of Zr—Al alloys, Zr—V—Fe alloys and their combinations, and wherein the ratio by weight between the H particles and the K particles are between about 1:10 to 10:1 and preferably between about 1:1 to 3:1.

By using powders of getter material having the aforesaid particle size and the aforesaid surface area, a good sorption capacity of the gases emitted during the manufacture of FEDs and during the whole life of the FEDs themselves is obtained. Sorbed gases are usually $H_2$ and gases containing oxygen (such as CO, $CO_2$, $H_2O$, $O_2$) which are very harmful to the microcathodes points. In particular, the sorption capacity in case of CO may reach a value around $0.5\times10^{-3}$ mbar×1/$cm^2$.

One of the dispersing means listed in the aforesaid patent GB-B-2,157,486 or other equivalent means may be used as suspending means.

The porous getter layer may be supported by a metallic substrate, by a conducting non-metallic substrate (for instance silicon) or by an insulating substrate. In case of a metallic substrate, the thickness is usually very thin, for example between about 5 μm and 50 μm; moreover, the substrate may be mono-metallic or multi-metallic, as described in the patent EP-B-0275844.

An example of a metallic substrate is a layer of titanium, molybdenum, zirconium, nickel, chrome-nickel alloys or iron-based alloys, possibly coupled with a layer of aluminum, as described in said patent EP-B-0274844; such a substrate may advantageously be a thin strip, preferably containing holes or slots of any shape, for example round, rectangular, square, polygonal, oval, lobed, elliptical, etc.

Another particular kind of metallic substrate may be one of the nonmagnetic alloys, based on iron and manganese, described in EP-A-0577898.

If the substrate is essentially insulating or non-metallic, a suspension of non-evaporable getter (NEG) may be directly deposited on such an insulating or non-metallic substrate. Alternatively, a mono-metallic or multi-metallic fixing layer, completely similar to the aforesaid metallic substrates, may be interposed between the substrate and the suspension.

According to an alternative preferred embodiment, a suspension of NEG may be separately deposited on a metallic strip and the strip may be mechanically housed in a micro-groove of the insulating substrate.

In order to perform the spray coating it may be advantageous to use the "multiple cycles" technique. This technique includes spraying the affected surface for a very short time, for example few seconds or even less than one second, and terminates the spraying for a time greater than the spray time, about 10 to 50 seconds, so as to let the volatile liquids evaporate, and then in repeating the spraying step, the evaporating step . . . and so on, until the desired thickness is achieved.

The multiple spraying may be advantageously performed with a single nozzle or, alternatively, the repeated use of a single nozzle may be replaced by using a sequence of single-step nozzles, suitably spaced along a support strip in motion; a second alternative provides for using a fixed strip sprayed by means of a sequence of proportioning nozzles in motion.

The suspensions used within the single cycles may be the same or mutually different; in certain cases it is even possible to spray, in one or more cycles, a suspension of A particles only (or H, for instance titanium hydride) and in a second sequence of one or more cycles a suspension of B particles only (or K, for instance Zr—V of Zr—V—Fe alloys). As an alternative, it is possible to use variable concentrations, for example gradually, of the two kinds of particles.

It is thus possible to advantageously obtain getter layers comprising elementary overlapping layers, having the same or a different composition; those sets of elementary layers, which have on the substrate side one or more elementary layers essentially consisting of titanium particles only, turned out to be very advantageous in view of the adherence to the substrate.

At the end of the spray depositing, the coated substrate is dried by means of a mild air-heating, for example at 70–80° C., and subsequently a vacuum sintering treatment is carried out, at a pressure lower than $10^{-5}$ mbar and at a temperature between about 650 and 1200° C.

Here, the term "sintering" means the process of heating a layer of getter material at a temperature and for a time sufficient to give a certain mass transfer among adjacent particles without excessively reducing the surface area. This mass transfer binds the particles together, thereby increasing their mechanical strength, and enables the adherence of the particles to the support; lower temperatures need longer times. According to a preferred embodiment of the present invention a sintering temperature which is the same or slightly higher than the sintering temperature of the H components and slightly lower than the sintering temperature of the K component.

In this description the term "insulating", given to one of the possible substrates, means any material which does not conduct electricity at the working temperature, for example pyroceram, quartz glass, quartz, silica, in general terms refractory metal oxides and in particular alumina.

Figure 3:
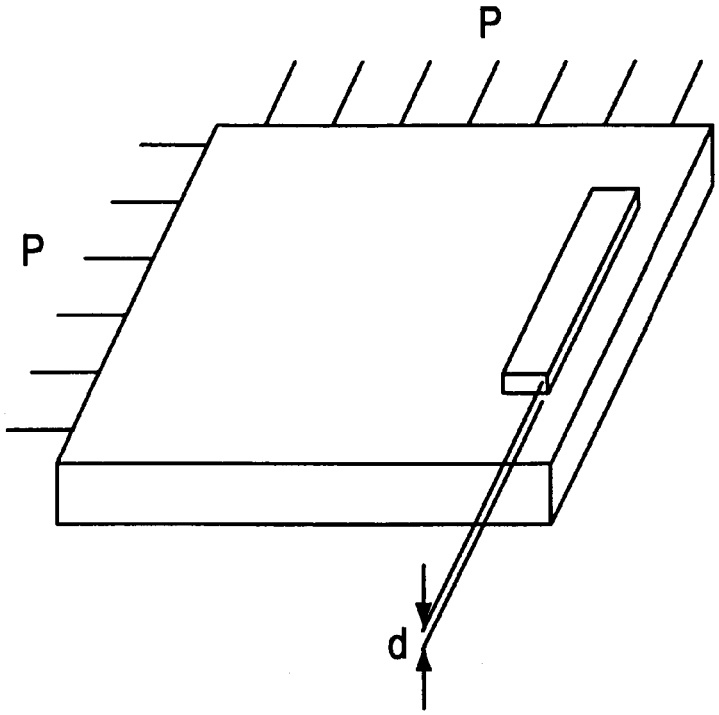
FIG. 3 is a perspective view of a FED insulting substrate ("rear plate") coated with a thin getter stripe having a thickness d.

FIG. 3 shows a Field Emitter Display in accordance with the present invention, without the fluorescent screen, wherein a quadrangular support is provided with a rectangular stripe of a porous NEG layer, having a thickness d, parallel to one of the sides of the support.

This stripe of porous getter may be thermally activated in an advantageous way by exploiting the same manufacturing process of the FED and in particular the step called frit sealing or the previous degassing step, wherein temperatures around 300–450° C. are reached; for details about the term "frit sealing" see the Italian patent application MI93A002422.

Moreover, the stripe of porous getter may be advantageously connected with one or more electric feedthroughs P, ready for a subsequent further activation, if the latter is needed.

Figure 4:
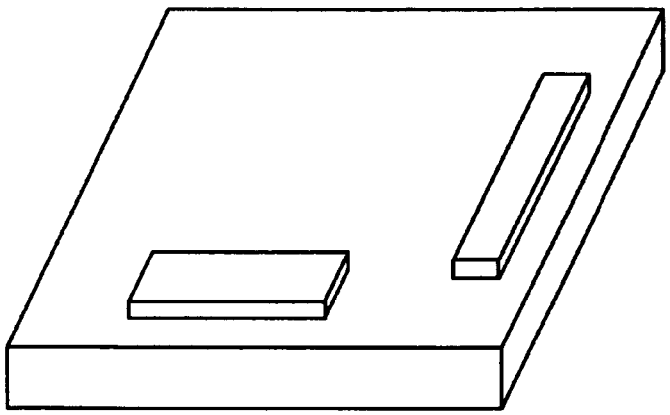
FIG. 4 is a perspective view of another "rear plate" embodiment coated by two getter strips.

FIG. 4 shows a FED similar to the one in FIG. 3, without showing the feedthroughs, provided with two mutually perpendicular stripes, wherein one is longer than the other.

FIG. 2 is a cross-section view of a field emitter display (FED) according to the invention, without the "tail", wherein an insulating substrate S and a porous layer of NEG (G) are separated by a metallic fixing strip NS.

EXAMPLE

The following example is offered merely for the purpose of illustration and is not intended to limit the present invention in any way.

150 g of titanium hydride, having a particle size lower than 60 μm, were introduced, together with 50 cc of demineralized water, in the steel container of a planetary ball mill.

After the natural evaporation of the water, a powder of titanium hydride having a particle size lower than 20 μm (average size: 3–5 μm) was obtained by adjusting the time (about 4 hours) and the milling speed and after the fixing of a suitable number and size combination of the balls in said container. The surface area was 8.35 $m^2/g$.

150 g of St 101 alloy (84% Zr, 16% Al), having a particle size lower than 53 μm, were milled at the same conditions and with the same parameters used for milling the titanium hydride; a powder consisting of particles having a size lower than 30 μm (average size: 8–19 μm) was thus obtained. The surface area was 2.06 $m^2/g$.

Subsequently, in a plastic bottle, 70 g of said milled titanium hydride were mixed with 30 g of said St 101 alloy, finely milled. These are the typical proportions for forming a composite getter material called St 121. Next were added 150 cc of suspending means obtained by mixing 300 cc of isobutyl acetate, 420 cc of isobutyl alcohol and 5.3 g of collodion cotton (nitrocellulose). The bottle was then sealed and mechanically shaken for a time longer than 4 hours.

There has been thus obtained a homogeneous suspension which, if stored for any period, must be shaken again for about two hours before being used.

The suspension was then deposited on the surface of a metallic support by means of a spray system comprising a plastic tank, a pressure-regulated spray needle-valve (model 780S Spray Valve of the EFD company) and a control unit (model Valvemate 7040 by EFD).

For the present example there were used metallic supports made of Ni—Cr, strip-shaped, 0.05 mm thick and 4 mm wide (in other tests sheets 0.02 mm thick have been used).

The valve was supported by a pole so that the spraying nozzle was about 30 cm away from the horizontal surface of the support. The depositing process comprised a sequence of steps (cycles) wherein the valve was opened for a second approximately, thereby letting the suspension flow as tiny droplets, and then closed for a period of 15 seconds approximately, wherein the suspension means could evaporate. In order to accelerate the latter process, the support was kept at about 30° C. by means of a heating support plate.

The thickness of the deposit of getter material was proportional to the number of spraying cycles.

The samples coated by a St 121 powder on one face only, were introduced into a vacuum oven, wherein the pressure was reduced to less than $10^{-5}$ mbar; the temperature was then increased up to approximately 450° C., value kept for about 15 minutes.

Thereafter, the temperature of the oven was increased up to 900° C. (sintering temperature) and kept for 30 minutes.

Finally, the system was cooled down to the ambient temperature and the coated supports were extracted from the oven; the deposit of sintered powder was 150 to 180 μm thick along the surface of the metallic support.

Figure 5:
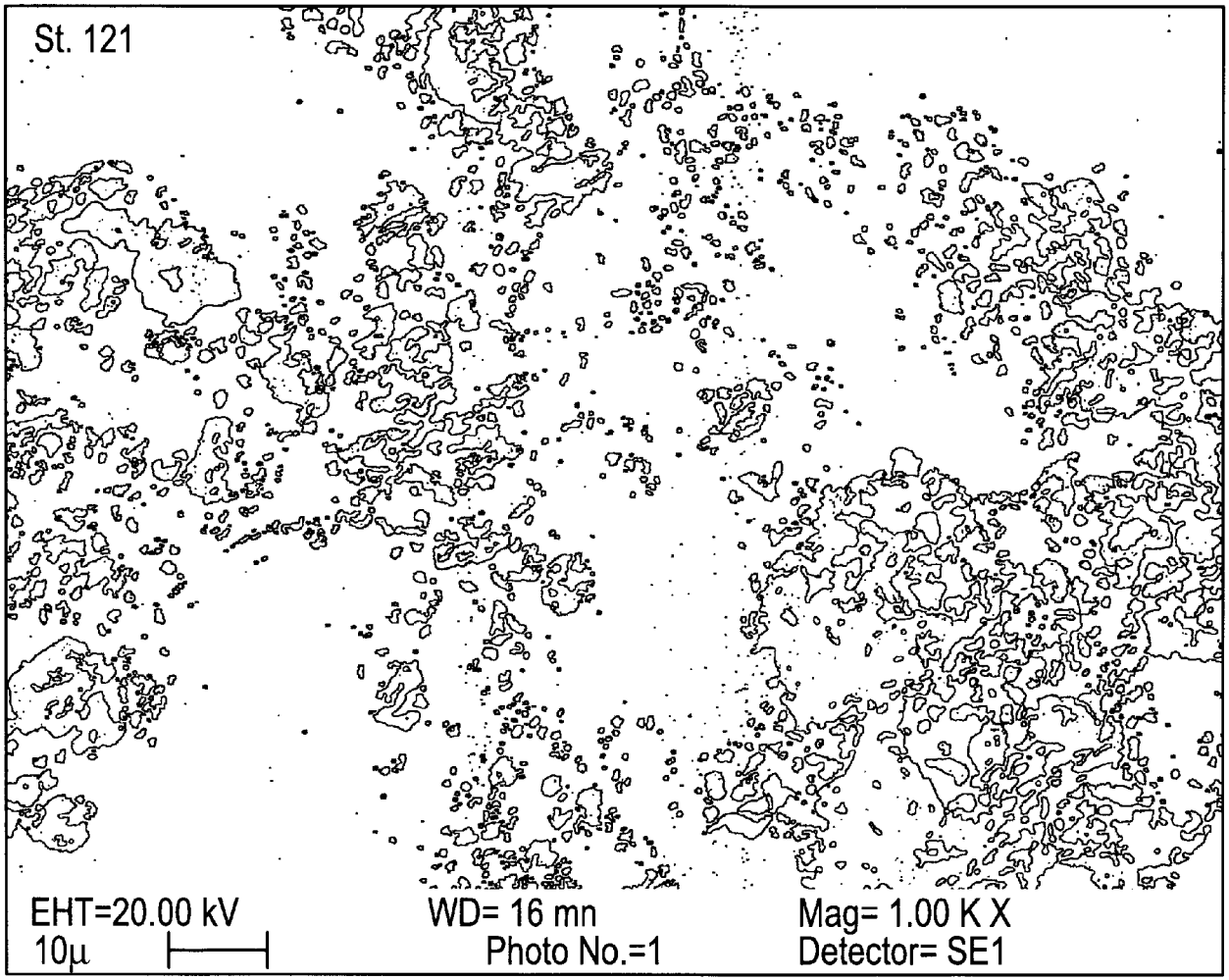
FIGS. 5 and 6 are illustrations of surfaces of supported porous layers.

FIG. 5 shows an illustration of a 1000 times magnification of a visible surface portion of the layer obtained according to the Example. The illustration of the sample clearly indicates a high degree of porosity and good sintering level.

Figure 6:
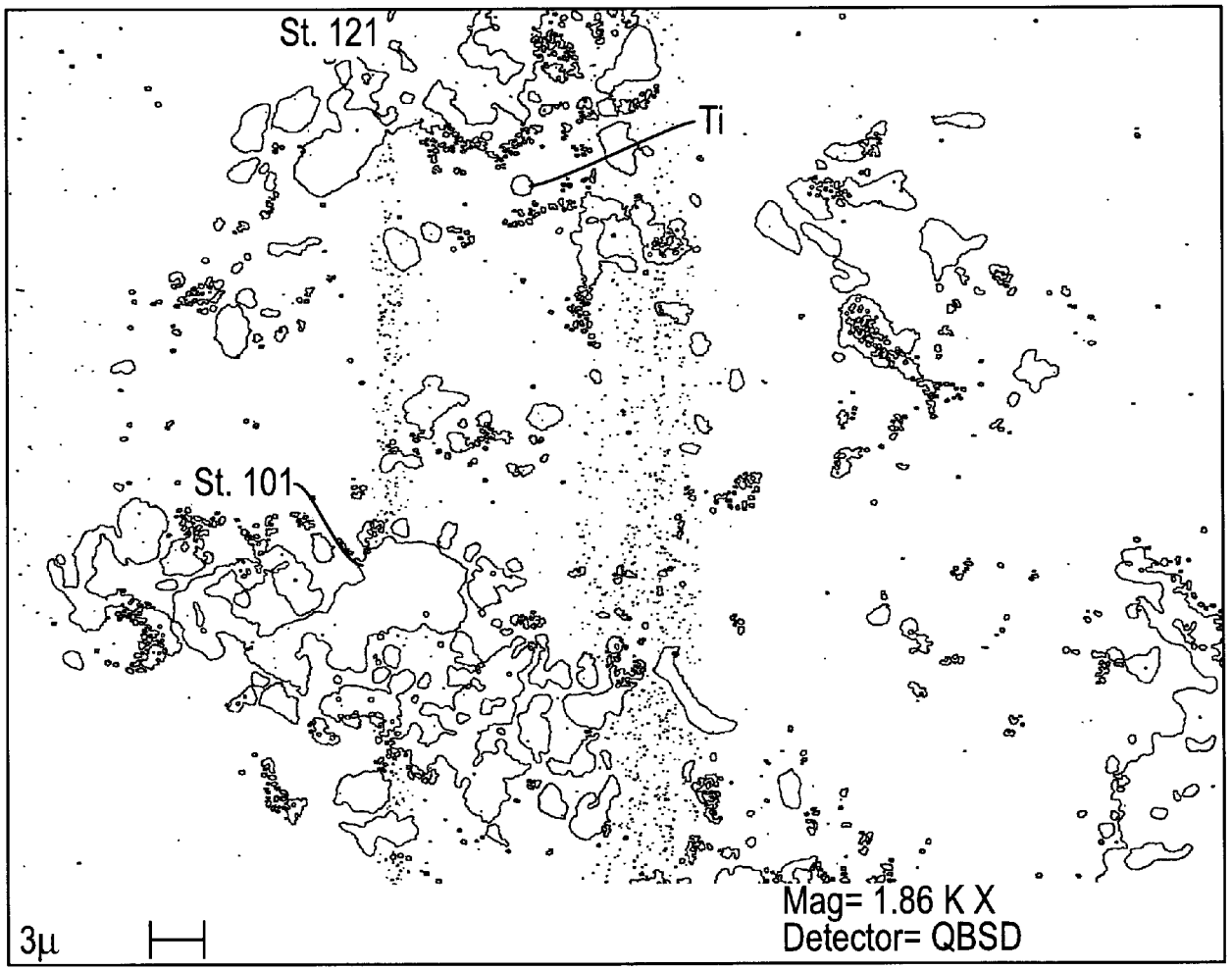

FIG. 6, is an illustration of a 1,860 times magnification of a visible surface portion of a portion of the cross-section of the same getter material layer of the Example (section A—A in FIG. 3). This illustration indicates not only good layer porosity, but also a uniform distribution of the sintered mixture components, as well as good fixing to the Ni—Cr substrate.

Figure 7:
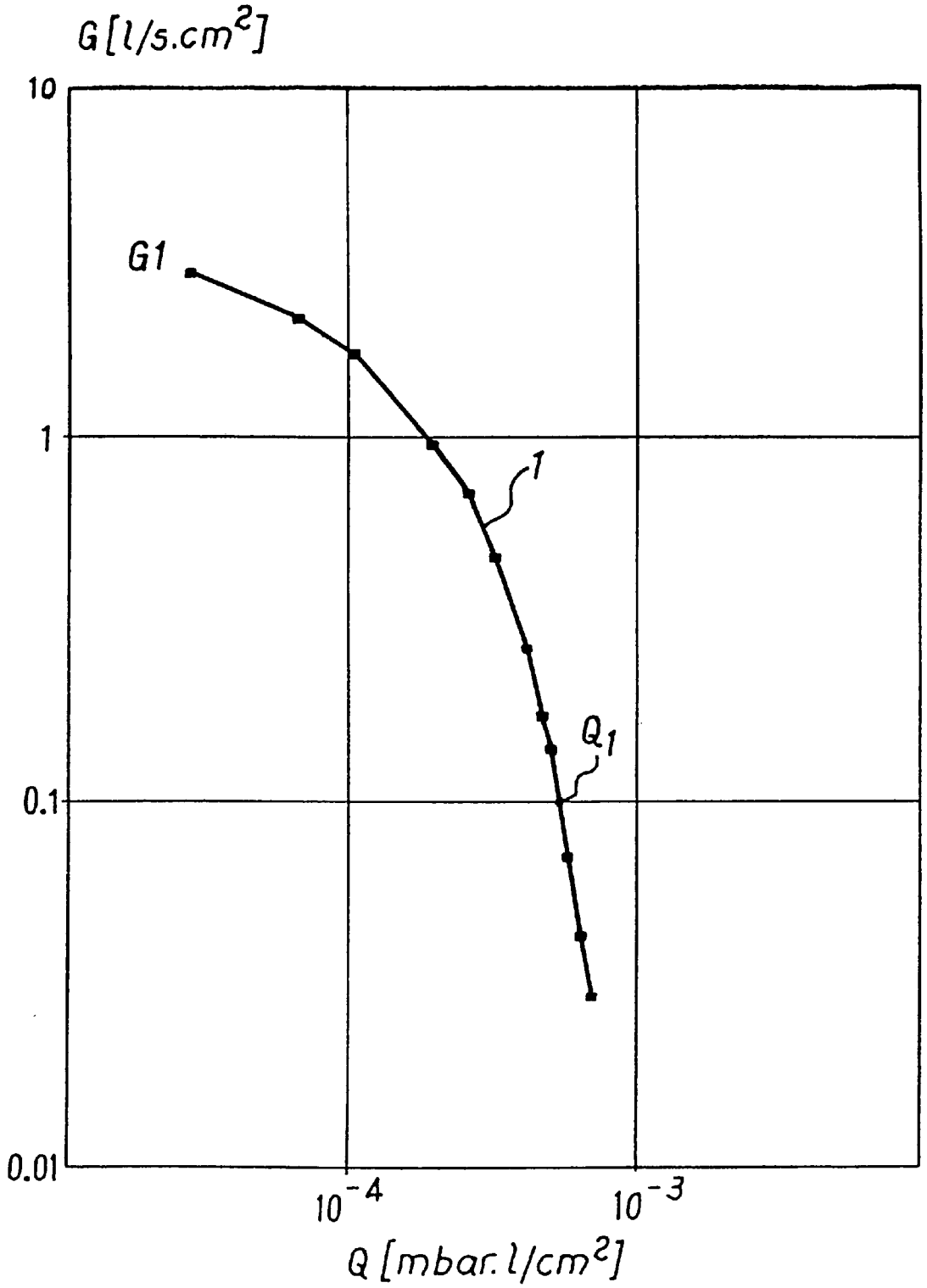
FIG. 7 shows carbon monoxide sorption test results using the testing methods described in PCT application WO 94/02957.

FIG. 7 is a graph of the results of carbon monoxide sorption tests for samples prepared in accordance with the Example. The tests were conducted using the methods described in WO 94/02957, except that the area of sorption is 1 $cm^2$ of the exposed surface. The X axis indicates the amount of carbon monoxide sorbed (Q). The Y axis indicates the pumping speed (G). The sorption tests were carried out with the following operative conditions:

sorption temperature: 25° C.;

activation temperature: 500° C. (for 10 minutes); and test pressure: $3\times10^{-5}$ mbar.

The results of these sorption tests indicate that samples prepared according to the Example exhibit the following properties:

an initial sorption speed of carbon monoxide $G_1$, equal to approximately 3 $L/S\cdot cm^2$.

a quantity of sorbed carbon monoxide $Q_1$ equal to approximately $0.5\times10^{31}$ $mbar\cdot L/cm^2$ when the pumping speed is reduced to 0.1 $L/s\cdot cm^2$.

Thus, using the getter materials described above it will be seen that the present invention provides an effective method of maintaining a high vacuum in field emitter flat displays without the drawbacks of present materials and methods.

All patent and non-patent references disclosed herein are incorporated by reference for all purposes.

The foregoing has been described with respect to certain disclosed embodiments and examples. However, it will be apparent to those of skill in the art that changes can be made to the embodiments and/or examples described herein without departing from the scope and/or spirit of the invention.

What is claimed is:

1. A process for producing a field emitter flat display comprising:

a) providing a porous layer by depositing a non-evaporable getter material on a substrate and by sintering said deposited material, a support layer is formed which separates said porous layer from said substrate;

b) housing said porous layer in an inner space; and c) evacuating and hermetically sealing said inner space.

2. A process according to claim 1, wherein said porous layer of non-evaporable getter material is thermally activated.

3. A process according to claim 1, wherein said inner space is hermetically sealed by means of a frit sealing operation, preceded by a degassing operation, said operations being carried out at temperatures effective to thermally activate said non-evaporable getter material.

4. A process according to claim 1, wherein said layer of said non-evaporable getter material is obtained by:

a) preparing a suspension of non-evaporable getter material particles in a suspending medium;

b) coating a surface of a supporting substrate with said suspension; and c) sintering said coating.

5. A process according to claim 4, wherein said particles are a mixture of particles selected from the group consisting of:

titanium hydride particles; and getter alloy particles wherein said getter alloy particles are chosen from the group consisting of Zr—Al alloys, Zr—V alloys, Zr—V—Fe alloys, and combinations thereof, and wherein the ratio by weight between the titanium hydride particles and the getter alloy particles is between about 1:10 to about 10:1.

6. A process according to claim 5, wherein said ratio of titanium hydride particles to said getter alloy particles is between about 1:1 and about 3:1.

7. The process according to claim 6, wherein said titanium hydride particles have an average size between about 1.0 $\mu$m and about 15.0 $\mu$m and a surface area of between about 1.0 $m^2/g$ and about 8.5 $m^2/g$; and said getter alloy particles have an average size between about 5.0 $\mu$m and about 15.0 $\mu$m and a surface area of between about 0.5 $m^2/g$ and about 2.5 $m^2/g$.

8. The process of claim 7 wherein said titanium hydride particles have an average size of between about 3.0 $\mu$m and about 5.0 $\mu$m and said getter alloy particles have an average size between about 8.0 $\mu$m and about 10.0 $\mu$m.

9. A process according to claim 4, wherein the act of coating includes spraying said surface of said substrate with said suspension for a predetermined time, said spraying being followed by a break, to allow for evaporation of said suspending medium, the time of said break being longer than said predetermined spraying time.

10. A process according to claim 4, wherein the act of coating includes spraying said surface of said substrate with said suspension for a predetermined time, said spraying being followed by a break to allow for evaporation of said suspending medium, the time of said break being longer than said predetermined spraying time, repeating the spraying and break multiple times (cycles), wherein the compositions of the suspensions used in different spraying cycles being at least in part mutually different.

11. A process according to claim 10, wherein at least the first spraying cycle is carried out with a suspension containing titanium hydride particles.

12. A process according to claim 1 wherein said supporting member is a fixing strip.

13. A process according to claim 1 wherein said supporting member is metallic.

14. A process for producing a field emitter flat display comprising:

preparing a suspension of non-evaporable getter material particles in a suspending medium;

spraying a surface of a supporting substrate with said suspension for a first period of time;

pausing for a second period of time to allow volatile components in said suspending medium to at least partially evaporate;

sintering said non-evaporable getter material particles to form a porous layer of non-evaporable getter material on said supporting substrate;

housing said supporting substrate having said porous layer of non-evaporable getter material thereon in an inner space; and evacuating and hermetically sealing said inner space.

15. The process of claim 14, wherein said non-evaporable getter material particles are titanium hydride particles.

16. The process of claim 14, wherein said non-evaporable getter material particles are particles of a non-evaporable getter material selected from the group consisting of Zr—Al alloys, Zr—V alloys, Zr—V—Fe alloys, and combinations thereof.

17. The process of claim 14, wherein said non-evaporable getter material particles are comprised of a mixture of titanium hydride particles and getter alloy particles selected from the group consisting of Zr—Al alloys, Zr—V alloys, Zr—V—Fe alloys, and combinations thereof, and wherein the ratio by weight between the titanium hydride particles and the getter alloy particles is between about 1:10 to about 10:1.

18. The process of claim 17, wherein the ratio of titanium hydride particles to getter alloy particles is between about 1:1 and about 3:1.

19. The process of claim 17, wherein said titanium hydride particles have an average size of between about 1.0 $\mu$m and about 15.0 $\mu$m and a surface area of between about 1.0 $m^2/g$ and about 8.5 $m^2/g$, and said getter alloy particles have an average size of between about 5.0 $\mu$m and about 15.0 $\mu$m and a surface area of between about 0.5 $m^2/g$ and about 2.5 $m^2/g$.

20. The process of claim 19, wherein said titanium hydride particles have an average size of between about 3.0 $\mu$m and about 5.0 $\mu$m, and said getter alloy particles have an average size of between about 8.0 $\mu$m and about 10.0 $\mu$m.

* * * * *